US006988486B2

(12) United States Patent
Ueda et al.

(10) Patent No.: US 6,988,486 B2
(45) Date of Patent: Jan. 24, 2006

(54) AIR-FUEL RATIO CONTROL APPARATUS FOR MULTIPLE CYLINDER ENGINE

(75) Inventors: Katsunori Ueda, Okazaki (JP); Hideyuki Handa, Okazaki (JP); Takashi Kanda, Aichi (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 5 days.

(21) Appl. No.: 10/875,269

(22) Filed: Jun. 25, 2004

(65) Prior Publication Data

US 2005/0183706 A1 Aug. 25, 2005

(30) Foreign Application Priority Data

Jun. 25, 2003 (JP) ..... 2003-181551

(51) Int. Cl.
*F02M 1/00* (2006.01)

(52) U.S. Cl. ..... 123/434; 123/673; 701/109

(58) Field of Classification Search ..... 123/434, 123/673, 680, 698, 674; 701/109
See application file for complete search history.

(56) References Cited

U.S. PATENT DOCUMENTS 6,830,042 B2 * 12/2004 Ikemoto ..... 123/673
6,868,326 B2 * 3/2005 Yasui ..... 701/101
2004/0007211 A1 * 1/2004 Kobayashi ..... 123/472
2004/0193358 A1 * 9/2004 Yasui ..... 701/109
2004/0206072 A1 * 10/2004 Surnilla et al. ..... 60/285
2004/0216450 A1 * 11/2004 Okazaki et al. ..... 60/285

FOREIGN PATENT DOCUMENTS

| | | | |
|---|---|---|---|
| DE | 3839611 | A1 | 5/1990 |
| DE | 4003752 | A1 | 8/1991 |
| DE | 4236008 | C2 | 4/1994 |
| DE | 19903721 | C1 | 7/2000 |
| DE | 10206402 | C1 | 4/2003 |

* cited by examiner

*Primary Examiner*—John T. Kwon
(74) *Attorney, Agent, or Firm*—Birch, Stewart, Kolasch & Birch, LLP

(57) ABSTRACT

An air-fuel ratio control apparatus for a multiple cylinder engine, having catalytic converters and air-fuel ratio sensors in an exhaust manifold, comprises exhaust air-fuel ratio variation determining means which determines a variation in exhaust air-fuel ratio between one cylinder and other cylinders in one cylinder group when an exhaust air-fuel ratio on one of the rich side and the lean side with respect to a predetermined value is detected as to the one cylinder twice in succession, an exhaust air-fuel ratio on the other one of the rich side and the lean side from the exhaust air-fuel ratio of the one cylinder, and combustion air-fuel ratio control means which feedback-compensates the quantity of fuel injected into the one cylinder, and feedback-compensated the quantity of fuel injected into the other cylinder in a direction opposite to the direction in which the quantity of fuel injected into the one cylinder is compensated.

6 Claims, 7 Drawing Sheets

AIR-FUEL RATIO CONTROL APPARATUS FOR MULTIPLE CYLINDER ENGINE

CROSS-REFERENCE TO RELATED APPLICATION

This application incorporates by references the subject matter of Application Ser. No. 2003-181551 filed in Japan on Jun. 25, 2003, on which a priority claim is based on 35 U.S.C. § 119(a).

BACKGROUND OF THE INVENTION (1) Field of the Invention

The present invention relates to an air-fuel ratio control apparatus for a multiple cylinder engine.

(2) Description of the Related Art

Generally, in a gasoline engine, feedback compensation is carried out in which the fuel injection quantity is increased or decreased according to an output signal from an air-fuel ratio sensor provided in an exhaust pipe. Particularly in an engine system provided with a three-way catalyst and an $O_2$ sensor, the fuel injection quantity is increased or decreased according to an output signal from an $O_2$ sensor, and the air-fuel ratio of exhaust gas is maintained at around a stoichiometric air-fuel ratio to raise the purification rate of the three-way catalyst, such that exhaust gas can be purified to keep the exhaust gas exhausted from a tail pipe clean.

In a multiple cylinder engine, in the case where there are variations in exhaust air-fuel ratio among cylinders, gas which is rich or lean is emitted from each cylinder even if the average exhaust air-fuel ratio of all the cylinders can be maintained at a stoichiometric air-fuel ratio. If exhaust gases from the respective cylinders cannot be sufficiently mixed in an exhaust pipe, a large quantity of HC and CO passes through a three-way catalyst when the air-fuel ratio is rich, and on the other hand, a large quantity of $NO_X$ passes through the three-way catalyst when the air-fuel ratio is lean, and therefore, the HC, CO, and $NO_X$ cannot be effectively purified.

To address this problem, a technique according to which the fuel injection quantity is compensated for by estimating variations in exhaust air-fuel ratio among cylinders according to a value detected by an air-fuel ratio sensor provided upstream of a three-way catalyst (refer to Japanese Laid-Open Patent Publication (Kokai) No. 2001-82221, for example).

According to this technique, the exhaust air-fuel ratios of the respective cylinders are separately estimated so that exhaust gas can be purified with no variations in exhaust air-fuel ratio among the cylinders.

By the way, according to the above conventional technique, a crank angle at which the concentration of exhaust gas from one of the cylinders becomes dominative around the $O_2$ sensor is obtained in advance by experiments or calculations, and the degree at which exhaust gas is rich or lean is detected independently for each cylinder according to the crank angle, and a deviation between the detection result and a stoichiometric air-fuel ratio are fed back, i.e., variations in exhaust air-fuel ratio are corrected by evaluating absolute values of the respective cylinders.

According to the above conventional technique, however, it is necessary to consider a response delay from exhaust valves of the respective cylinders to the $O_2$ sensor, and in particular, if an exhaust pipe is not uniform in length, complicated model programming, experiments, and so forth for determining a crank angle at which the concentration of exhaust gas from one of the cylinders becomes dominative must be conducted to accurately recognize a response delay of each cylinder.

Namely, according to the above conventional technique, although variations in exhaust air-fuel ratio can be reduced, there is still the problem that it is impossible to provide control to easily reduce variations in exhaust air-fuel ratio.

It is therefore an object of the present invention to provide an air-fuel ratio control apparatus for a multiple cylinder engine, which is capable of correcting variations in exhaust air-fuel ratio among cylinders in a relatively easy way.

SUMMARY OF THE INVENTION

An air-fuel ratio control apparatus for a multiple cylinder engine of the present invention comprises, an exhaust passage into which exhaust gas from a plurality of cylinders in the multiple cylinder engine flows, a catalytic converter provided in the exhaust passage, air-fuel ratio detecting means, provided upstream of the catalytic converter in the exhaust passage, for generating a detection output corresponding to an exhaust air-fuel ratio, combustion air-fuel ratio control means for controlling fuel injection quantity according to the generated detection output from the air-fuel ratio detecting means, whereby the average air-fuel ratio of exhaust flow into the catalytic converter is adjusted to be around a stoichiometric ratio, and exhaust air-fuel ratio variation determining means for determining that there is a variation in exhaust air-fuel ratio between one cylinder and other cylinder when an output for one cylinder from the air-fuel ratio detecting means indicates one of a rich side and a lean side twice in succession, and in the meantime, an output for the other cylinder from the air-fuel ratio detecting means indicates another one of the rich side and the lean side from the air-fuel ratio indicated by the detection value for the one cylinder, and in which when the exhaust air-fuel ratio variation determining means determines that there is a variation in the exhaust air-fuel ratio, the combustion air-fuel ratio control means compensates for the fuel injection quantity to reduce the variation.

BRIEF DESCRIPTION OF THE DRAWINGS

The nature of this invention, as well as other objects and advantages thereof, will be explained in the following with reference to the accompanying drawings, in which like reference character designate the same or similar parts throughout figure and wherein.

DETAILED DESCRIPTION OF THE INVENTION

The present invention will now be described in detail with reference to the drawings showing an embodiment thereof.

Figure 1:
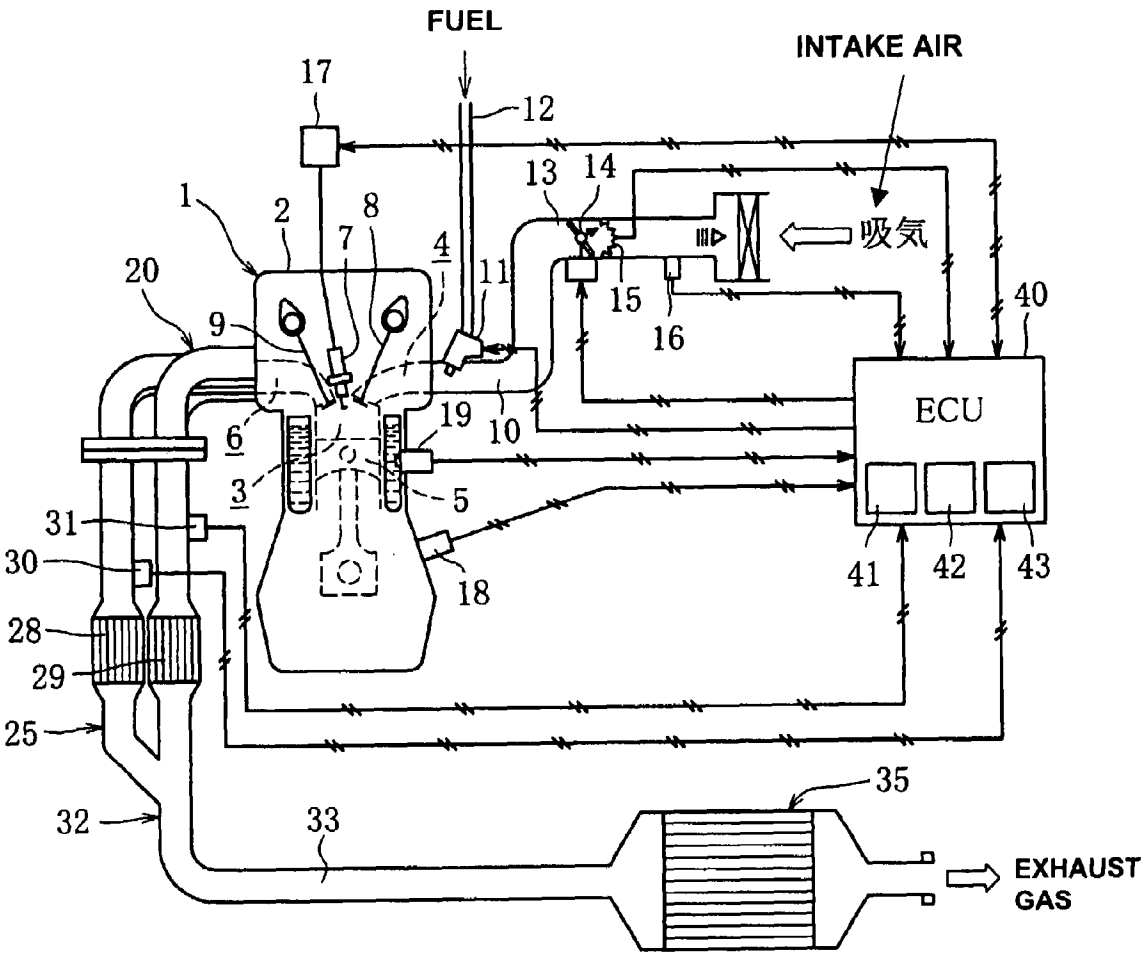
FIG. 1 is a diagram schematically showing an engine to which an air-fuel ratio control apparatus for a multiple cylinder engine according to an embodiment of the present invention is applied.

FIG. 1 is a diagram schematically showing the construction of an engine to which an air-fuel ratio control apparatus for a multiple cylinder engine according to an embodiment of the present invention is applied. A description will now be given of the construction of the air-fuel ratio for the multiple cylinder engine according to the present invention with reference to FIG. 1.

A multi-point injection engine (MPI engine), which is capable of injecting fuel via an intake manifold 10, is adopted as a four cylinder engine (hereinafter referred to as an "engine") 1 in the present embodiment.

As shown in FIG. 1, in a cylinder head 2 of the engine 1, intake ports 4 are formed in a substantially horizontal direction for respective four cylinders, and intake valves 8 which connect and disconnect the intake ports 4 to and from respective combustion chambers 3 are provided on the combustion chamber 3 sides of the respective intake ports 4.

One end of the intake manifold 10 is connected to the intake ports 4. Electromagnetic injectors 11 which inject fuel into the respective four cylinders #1 to #4 are mounted on the intake manifold 10, and a fuel supply device, not shown, including a fuel tank is connected to the injectors 11. The injectors 11 inject fuel toward the combustion chambers 3 during, e.g., an exhaust stroke of pistons 5.

One end of an intake pipe 13 is connected to the intake manifold 10. The intake pipe 13 is provided with an electromagnetic throttle valve 14 which controls the intake air volume, and a throttle position sensor (TPS) 15 which detects the throttle valve opening is provided in the vicinity of the throttle valve 14. Further, a Karman vortices air flow sensor 16 which detects the intake air volume is provided upstream of the throttle valve 14. Fresh air is taken into the cylinders #1 to #4 via the intake manifold 10.

Further, in the cylinder head 2, ignition plugs 7 are attached to the respective cylinders, and ignition coils 17 which output high voltage are connected to the respective ignition plugs 7, for performing spark ignition of an air-fuel mixture of fresh air from the intake pipe 13 and fuel from the injectors 11 in the combustion chambers 3.

Further, in the cylinder head 2, exhaust ports 6 are formed in a substantially horizontal direction for the respective four cylinders, and exhaust valves 9 which connect and disconnect the exhaust ports 6 to and from the respective combustion chambers 3 are provided on the combustion chamber 3 sides of the respective exhaust ports 6.

Figure 2:
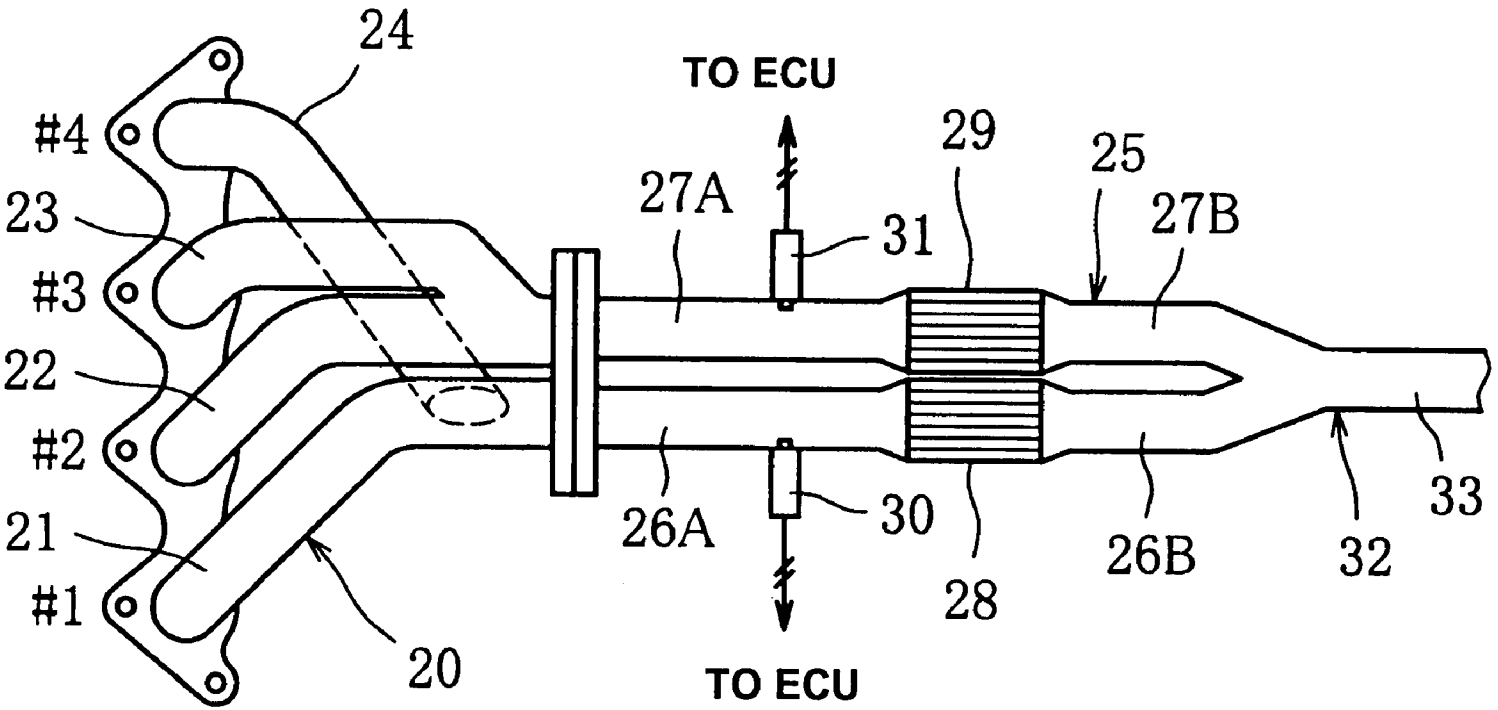
FIG. 2 is a system diagram showing a dual type manifold in FIG. 1.

One end of an exhaust manifold 20 is connected to the exhaust ports 6. Here, it is assumed that the exhaust manifold 20 is based on a dual type exhaust manifold system as shown in FIG. 2.

The exhaust manifold 20 is comprised of a first passage 21 for constituting the flow of exhaust gas from the first cylinder (#1), a second passage 22 for constituting the flow of exhaust gas from the second cylinder (#2), a third passage 23 for constituting the flow of exhaust gas from the third cylinder (#3), and a fourth passage 24 for constituting the flow of exhaust gas from the second cylinder (#4). In the case where exhaust gases are combusted in the first (#1), second (#2), third (#3), and fourth (#4) cylinders in this order, the first cylinder (#1) and the fourth cylinder (#4) which are not continuous in order of combustion are collected into one cylinder group, and the second cylinder (#2) and the third cylinder (#3) which are not continuous in order of combustion are collected into the other cylinder group, so that the flow of exhaust gas from the first passage 21 and the flow of exhaust gas from the fourth passage 24 are caused to join together, and the flow of exhaust gas from the second passage 22 and the flow of exhaust from the third passage 23 are caused to join together. This reduces exhaust gas interference in the exhaust manifold 20, and obtains a great exhaust inertia or exhaust pulsating effect.

An exhaust pipe 33 is connected to the other end of the exhaust manifold 20 via a collecting pipe 25, which is comprised of two pipes (dual pipes): one pipe including exhaust passages 26A and 26B connected to the first passage 21 and the fourth passage 24, and the other pipe including exhaust passage 27A and 27B connected to the second passage 22 and the third passage 23. Specifically, the collecting pipe 25 is configured such that exhaust gases from the one cylinder group including the cylinders #1 and #4 flow through the exhaust passages 26A and 26B, and exhaust gases from the other cylinder group including the cylinders #2 and #3 flow through the exhaust passages 27A and 27B.

A three-way catalyst (manifold catalytic converter (MCC)) 28 is interposed between the exhaust passage 26A and the exhaust passage 26B, and likewise, a three-way catalyst (MCC) 29 is interposed between the exhaust passage 27A and the exhaust passage 27B. Since the MCCs 28 and 29 are disposed at locations close to the engine 1, they can be quickly activated even when the engine 1 is cold, and therefore, exhaust substances (HC, CO, and $NO_x$) can be purified in a preferable manner irrespective of the operative state of the engine 1.

An $O_2$ sensor 30 as an air-fuel ratio sensor which outputs an ON/OFF signal according to whether the air-fuel ratio of exhaust gas is rich or lean is provided in the exhaust passage 26A, i.e., at a location upstream of the MCC 28, and likewise, an $O_2$ sensor 31 as an air-fuel ratio sensor is disposed in the exhaust passage 27A, i.e., at a location upstream of the MCC 29, so that the concentration of oxygen in exhaust gas as well as the air-fuel ratio of exhaust gas can be detected.

Further, a three-way catalyst (underfloor catalytic converter (UCC)) 35 as a rear catalytic converter is disposed in the exhaust pipe 33, making it possible to purify exhaust substances in a more preferable manner.

An electronic control unit (ECU) 40 is comprised of an input/output device, storage devices (such as a ROM, a RAM, and a nonvolatile RAM), a central processing unit (CPU), and so forth, and controls the overall operation of the engine 1.

Variety of sensors such as a crank angle sensor 18 which detects the revolutionary speed of the engine 1, and a water temperature sensor 19 which detects the cooling water temperature of the engine 1, as well as the above-mentioned TPS 15, air flow sensor 16, and $O_2$ sensors 30 and 31 are connected to the input side of the ECU 40. It should be noted that when a crank angle is detected by the crank angle sensor 18, a cylinder in which combustion is currently performed is determined according to the detected crank angle.

On the other hand, various output devices such as the above-mentioned injectors 11, ignition coils 17, and throttle valves 14 are connected to the output side of the ECU 40, and signals indicative of fuel injection quantity, fuel injection timing, and ignition timing calculated based on information detected by various sensors are output to those output devices. Therefore, a proper quantity of fuel can be injected at a proper timing from the injectors 11, and spark ignition can be performed in proper timing by the ignition plugs 17.

In particular, in the air-fuel ratio control apparatus according to the present invention, the ECU 40 is provided with an exhaust air-fuel ratio variation determining section (exhaust air-fuel ratio variation determining means) 41, a combustion air-fuel ratio control section (combustion air-fuel ratio control means) 42, and a combustion air-fuel ratio leaning section (combustion air-fuel ratio leaning means) 43 to correct variations among cylinders by simple and stable determination using the $O_2$ sensors 30 and 31 which are inexpensive.

The exhaust air-fuel ratio variation determining section 41 detects whether or not there is a variation in exhaust air-fuel ratio between cylinders which are continuous in order of combustion. Specifically, if one cylinder group is taken as an example, when the exhaust air-fuel ratio of one cylinder (for example, the cylinder #1) detected by the $O_2$ sensor 30 sequentially indicates one of the rich side and the lean side twice in succession, and the exhaust air-fuel ratio of the other cylinder (for example, the cylinder #4) detected by the $O_2$ sensor 30 indicates the other one of the rich side and the lean side from the exhaust air-fuel ratio of the cylinder #1 while the exhaust air-fuel ratio of the cylinder #1 is detected twice in succession, the exhaust air-fuel ratio variation determining section 41 detects that there is a variation in exhaust air-fuel ratio between the cylinders #1 and #4, and then outputs the determination result to the combustion air-fuel ratio control section 42.

The combustion air-fuel ratio control section 42 compensates for the fuel injection quantity to maintain the average exhaust air fuel ratio of one cylinder and the other cylinder according to an output signal from the exhaust air-fuel ratio variation determining section 41. If the above one cylinder group is taken as an example again, the combustion air-fuel ratio control section 42 compensates for the quantity of fuel injected into the cylinder #1, and compensates for the quantity of fuel injected into the cylinder #4 in a direction opposite to the direction in which the quantity of fuel injected into the cylinder #1 is compensated for, to maintain the average exhaust air-fuel ratio of the cylinders #1 and #4, and then outputs the result to the combustion air-fuel ratio leaning section 43.

When an output signal from the combustion air-fuel ratio control section 42 indicates that a compensated fuel injection quantity is not greater than a predetermined limit value, the combustion air-fuel ratio leaning section 43 stores and learns the compensated fuel injection quantity, which is to be used for the next compensation.

Figure 3:
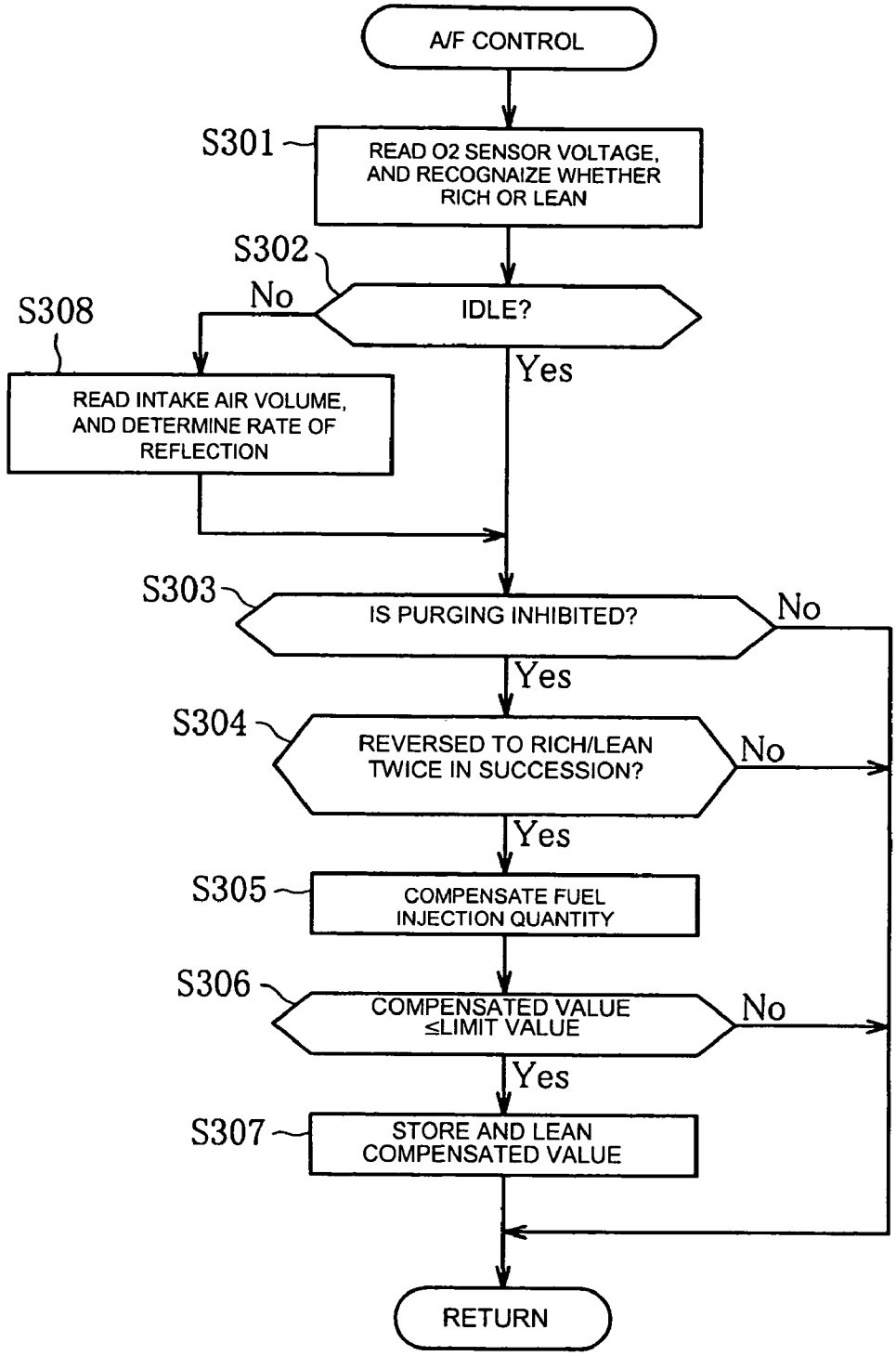
FIG. 3 is a flowchart showing an air-fuel control process carried out by the air-fuel ratio control apparatus in FIG. 1.

FIG. 3 is a flow chart showing an air-fuel ratio control routine executed by the air-fuel ratio control apparatus according to the present invention, and a description will now be given with reference to this flow chart.

If the above one cylinder group is taken as an example again, first, in step S301, the exhaust air-fuel ratio variation determining section 41 reads an output voltage from the $O_2$ sensor 30, and recognizes whether the exhaust air-fuel ratio of the cylinder #1 or #4 is rich or lean, and the process proceeds to step S302.

FIG. 4 shows the output voltage from the $O_2$ sensor 30, which is read by the exhaust air-fuel ratio variation determining section 41.

Figure 4A:
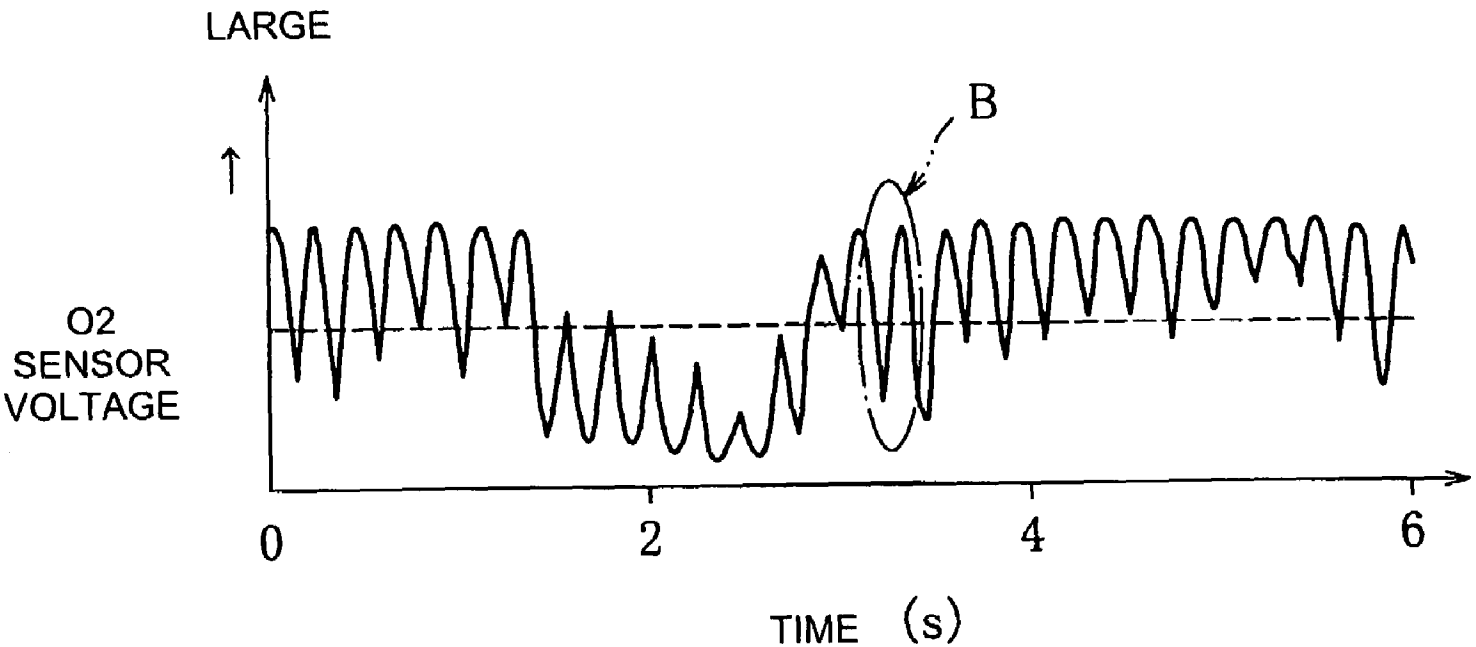
FIG. 4A is a graph showing a variation in output voltage from an $O_2$ sensor.
Figure 4B:
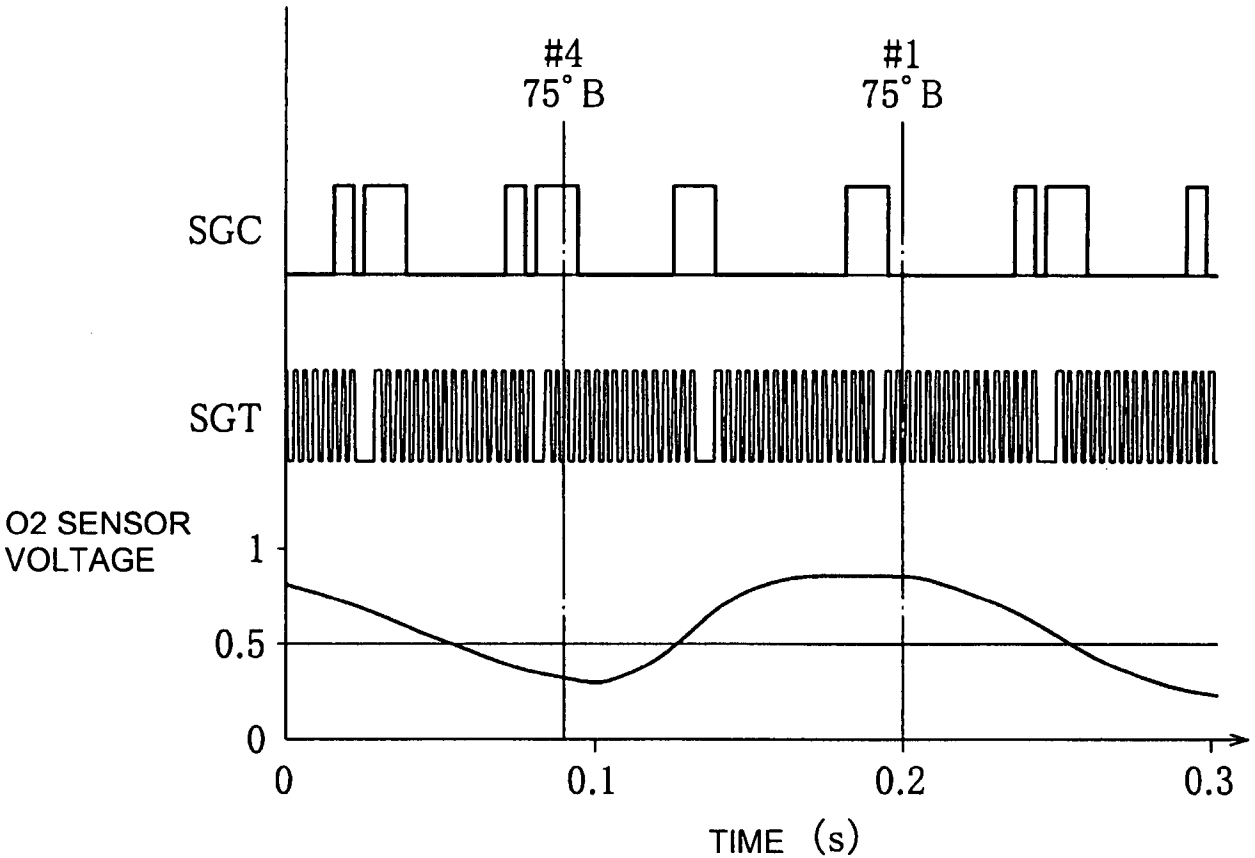
FIG. 4B is a graph showing part B of FIG. 4A with the time scale enlarged.

FIG. 4A shows a variation in output voltage from the $O_2$ sensor 30 in six seconds, and FIG. 4B shows a part B of FIG. 4 with time scale enlarged.

In the present embodiment, the output voltage from the $O_2$ sensor 30 should not vary according to strokes, i.e., with respect to the cylinders #1 and #4 in the present embodiment, but gradually varies as time passes. On the other hand, if there is a variation in exhaust air-fuel ratio between the cylinders #1 and #4, the output voltage from the $O_2$ sensor 30 rises or falls in synchronism with exhaust cycles, i.e., cyclically changes as shown in FIG. 4A. Therefore, according to the present invention, attention is focused on variations in output voltage from the $O_2$ sensor among strokes.

Here, if a variation in output voltage due to rise and fall as stated above is considered together with a signal indicative of the crank angle detected by the crank angle sensor 18, it is found that the output voltage rises and falls at an interval of a crank angle of 360° (SGC) as shown in FIG. 4B. Also, it is found that an output voltage around 75° B from a concaved position indicates the air-fuel ratio of the cylinders #1 and #4 (SGT). Further, in consideration of a response delay before the flow of exhaust gas from the combustion chamber 3 reaches the $O_2$ sensor 30, the period of time for which the flow of exhaust gas from the cylinder #1 reaches the $O_2$ sensor 30 in the exhaust passage 26A via the first passage 21, and the period of time for which the flow of exhaust from the cylinder #4 reaches the $O_2$ sensor 30 in the exhaust passage 26A via the fourth passage 24 correspond to a crank angle after about one and half rotations, and therefore, the output voltage around 75° B can be considered as representative of the exhaust air-fuel ratio of the cylinders #1 and #4 in the previous combustion.

Therefore, the exhaust air-fuel ratio variation determining section 41 detects the exhaust air-fuel ratio of the cylinders #1 and #4 according to the output voltage form the $O_2$ sensor around 75° B, and determines that the exhaust air-fuel ratio is rich when the detected value is greater than a median value (0.5 V) as an example of a predetermined value of output voltage, and determines that the exhaust air-fuel ratio is lean when the detected value is lower than the median value. Thus, compensating the fuel injection quantity using only the output voltage around 75° B makes control hunting unlikely to occur. It should be noted that the median value is in the vicinity of a median value of the output voltage (about 0.2 to 0.9 V) from the $O_2$ sensor 30, and is determined in consideration of characteristic stability.

In step S302, the combustion air-fuel ratio control section 42 determines whether the engine 1 is idling or not according to information supplied from, e.g., the water temperature sensor 19. If it is determined that the engine is idling, i.e., if the determination result is positive (YES), the process proceeds to step S303. If the fuel injection quantity is compensated for only when the engine 1 is idling at a low speed, with a low load applied thereto, and without acceleration and deceleration, the flows of exhaust gas from the cylinders #1 and #4 are not mixed. It should be noted that if it is determined in step S302 that the engine 1 is not idling, the process proceeds to step S308.

In step S303, the combustion air-fuel ratio control section 42 determines whether or not gas evaporated from the fuel tank is inhibited from being purged. If it is determined that gas evaporated form the fuel tank is inhibited from being purged, i.e., if the determination result is positive (YES), the process proceeds to step S304. If the fuel injection quantity is compensated for only when purging is inhibited, the exhaust air-fuel ratio can be prevented from being varied due to introduction of evaporated gas.

In step S304, the exhaust air-fuel ratio variation determining section 41 determines whether the determination result as to the exhaust air-fuel ratio of the one cylinder and the determination result as to the exhaust air-fuel ratio of the other cylinder have been reversed twice in succession. In other words, the present statuses of the cylinders #1 and #2 (in the previous combustion) are recognized. Referring again to FIG. 4B, it is recognized that the exhaust air-fuel ratio of the cylinder #4 is lean, and the exhaust air-fuel ratio of the cylinder #1 is rich, and thus, the determination result as to the exhaust air-fuel ratio of the cylinder #4 and the determination result as to the exhaust air-fuel ratio of the cylinder #1 are different. Therefore, in the illustrated example, according to this determination result and the determination result as to the air-fuel ratio of the cylinder #1 detected previously (in the last but one combustion) or the determination result as to the exhaust air-fuel ratio of the cylinder #4 which is subsequently detected (in the current combustion), it is determined whether or not the determination result (rich or lean) as to exhaust air-fuel ratio of the cylinder #1 and the determination result (rich or lean) as to the exhaust air-fuel ratio of the cylinder #4 have been reversed twice in succession.

Specifically, the exhaust air-fuel ratio variation determining section 41 determines whether or not the determination result (rich or lean) as to exhaust-air-fuel ratio of the cylinder #1 in the last but one combustion and the determination result (rich or lean) as to exhaust air-fuel ratio of the cylinder #4 in the previous combustion have been reversed, and the determination result as to the cylinder #4 in the last but one combustion and the determination result as to the cylinder #1 in the previous combustion have been reversed. If the determination results (rich or lean) have been reversed twice in succession, i.e., if the determination result is positive (YES), the exhaust air-fuel ratio variation determining section 41 determines that there is a variation in exhaust air-fuel ratio between the cylinders #1 and #4, and outputs the result to the combustion air-fuel ratio control section 42. The process then proceeds to step S305.

In step S305, the combustion air-fuel ratio control section 42 feedback-compensates the quantity of fuel injected into one cylinder to maintain the average exhaust air-fuel ratio of the one cylinder and the other cylinder, and feedback-compensates the quantity of fuel injected into the another cylinder in a direction opposite to the direction in which the quantity of fuel injected into the one cylinder is compensated for, and outputs the result to the combustion air-fuel ratio leaning section 43. The process then proceeds to step S306. In the illustrated example, since it is recognized that the air-fuel ratio of the cylinder #1 is rich and the exhaust air-fuel ratio of the cylinder #4 is lean, compensation is carried out such that the quantity of fuel injected into the cylinder #1 is decreased, and the quantity of fuel injected into the cylinder #4 is increased. On this occasion, an increase in the quantity of fuel injected into the cylinder #4 is equal to a decrease in the quantity of fuel injected into the cylinder #1. Correcting for a variation in exhaust air fuel ratio by comparative evaluation i.e., comparison of the cylinders #1 and #4 enables the average exhaust air-fuel ratio of the cylinders #1 and #4 to be maintained at, e.g., a stoichiometric air-fuel ratio without the necessity of using correction reference values for the respective cylinders.

In step S306, the combustion air-fuel ratio leaning section 43 determines whether or not the fuel injecting quantity which has been feedback-compensated (compensated value) is equal to or less than a predetermined limit value. The predetermined limit value is determined in consideration of the fact that a variation in exhaust air-fuel ratio is corrected for by integrating the fuel injection quantity, and is set so that it is not an excessive compensated value. This realizes failsafe. If it is determined that the compensated value is equal to or less than the predetermined limit value, i.e., if the determination result is positive (YES), the process proceeds to step S307 wherein the compensated value is leaned and stored. Then, the present routine is brought to an end.

It should be noted that if it is determined in steps S303, S304, and S306 that purging is not inhibited, the determination results (rich or lean) have not been reversed twice in succession, and the compensated value is not equal to or greater than the predetermined limit value, the present routine is brought to an end. Also, the leaned value is maintained until an in-vehicle battery is turned off.

Figure 5:
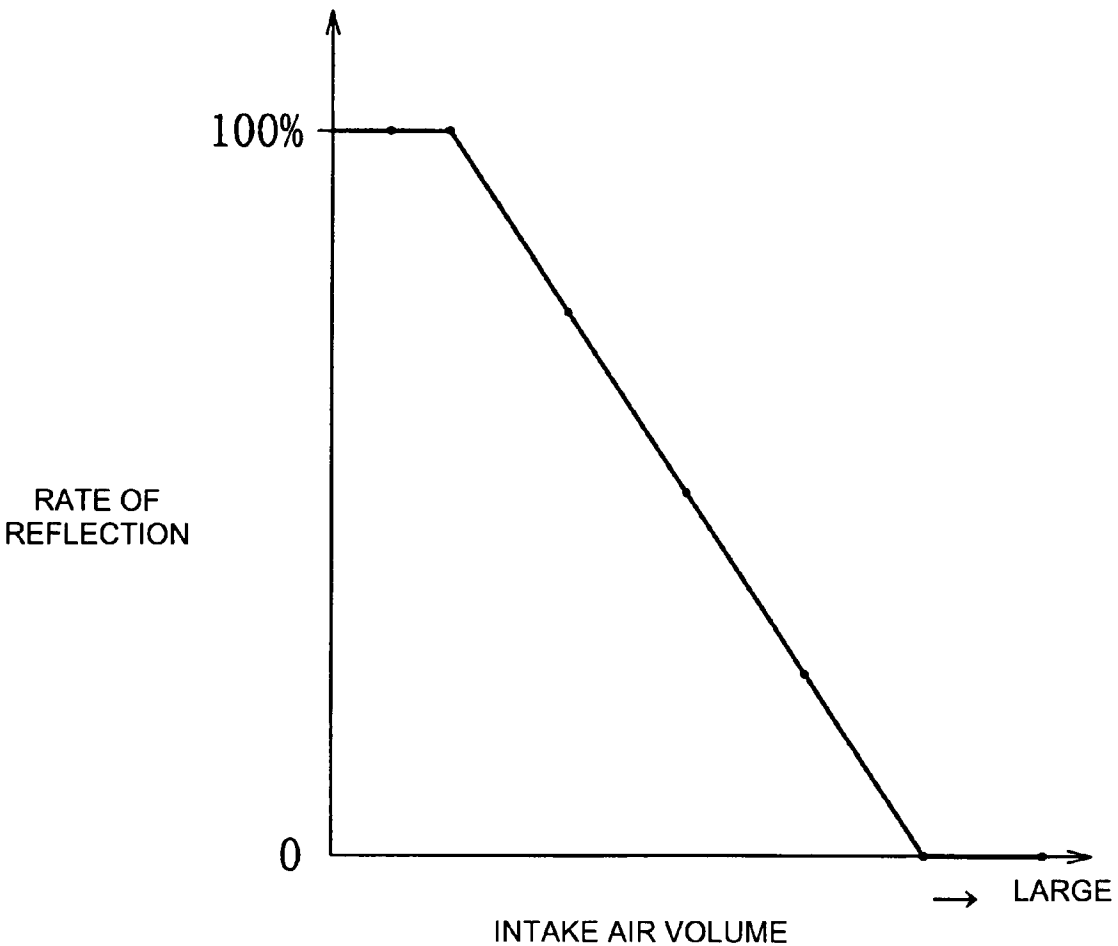
FIG. 5 is a graph showing the relationship between the intake air volume and the degree of dependency on learned fuel injection quantity in the air-fuel ratio control apparatus in FIG. 1.

On the other hand, the degree of dependency on the leaned value obtained by the combustion air-fuel ratio leaning section 43 is lowered since it is determined in step S302 that the engine 1 is not idling. Specifically, as shown in FIG. 5, the rate of reflection of leaned value is determined according to the intake air volume detected by the air flow sensor 16 using a map stored in the ECU 40, and then the process proceeds to step S303. This is because when the engine 1 is revolving at a high speed, there is only a little variation in exhaust air-fuel ratio, although the compensated fuel injection quantity is reflected even when the engine 1 is not idling during driving. As a result, control can be optimized.

Figure 6:
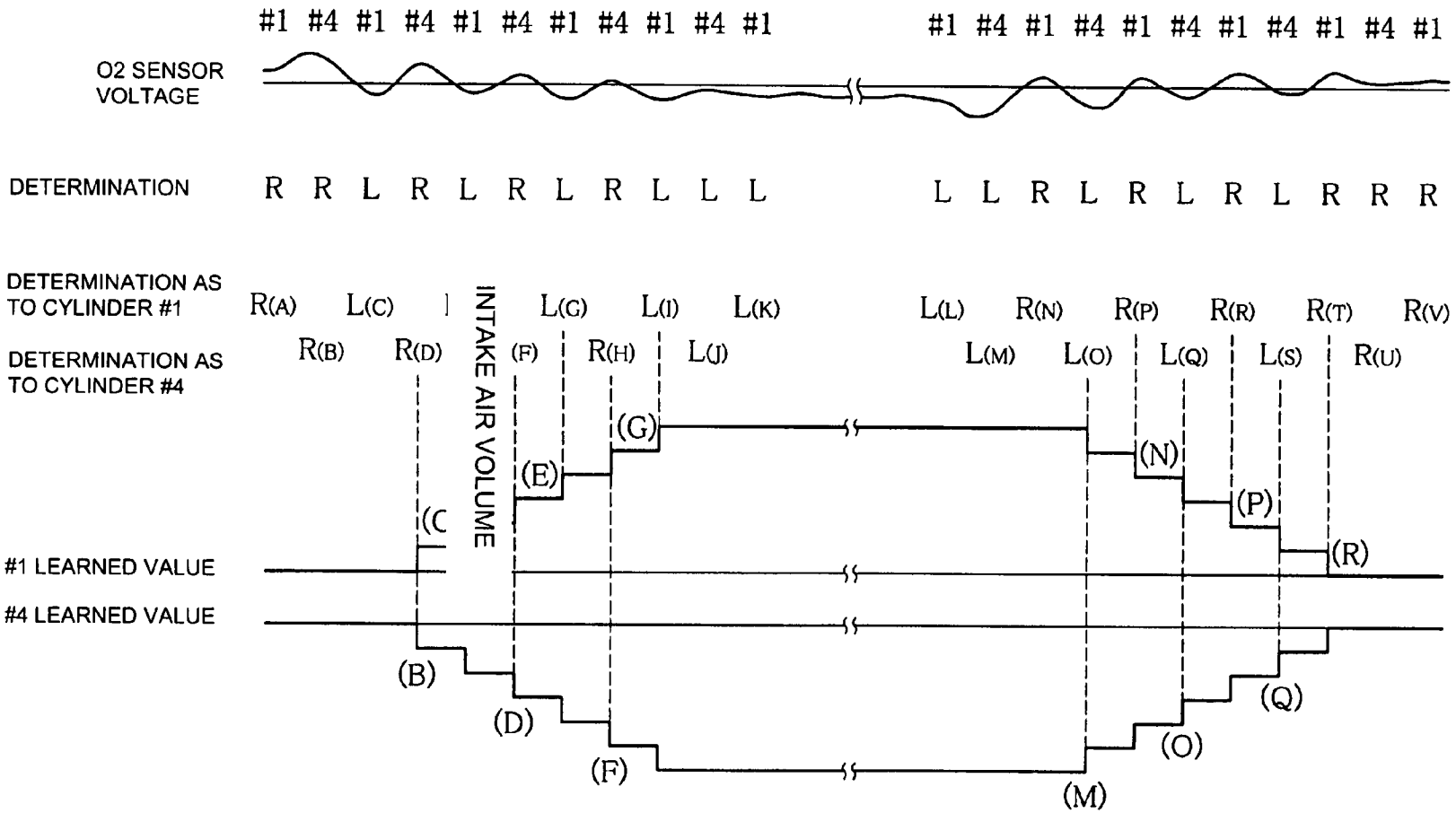
FIG. 6 is a timing chart of air-fuel ratio control provided by the air-fuel ratio control apparatus in FIG. 1.

FIG. 6 is a timing chart of air-fuel ratio control provided by the air-fuel ratio control apparatus according to the present invention. In the following description referring to this timing chart, the above one cylinder group is taken as an example.

The exhaust air-fuel ratio variation determining section 41 detects output voltages in timing of 75° after exhaust strokes of the cylinders #1 and #4 and before the flow of exhaust gas reaches the $O_2$ sensor 30, and sequentially recognizes the exhaust air-fuel ratios of the cylinders #1 and #4 in this timing. Then, the exhaust air-fuel ratio variation determining section 41 then determines whether the determination result (rich or lean) as to air-fuel ratio the cylinder #1 and the determination result (rich or lean) as to the air-fuel ratio of the cylinder #4 have been reversed.

As shown in FIG. 6, the output voltage from the $O_2$ sensor 30 indicates a rich air-fuel ratio R(A) of the cylinder #1 (A), and a rich air-fuel ratio R(B) of the cylinder #4 in the next combustion, and this means that the determination results have not been reversed. However, the output voltage indicates a lean air-fuel ratio L(C) for the cylinder #1 in the next combustion, which has been reversed from the previously detected rich air-fuel ratio R(B) of the cylinder #4. This is the first reversal. Then, the output voltage indicates a rich air-fuel ratio R(D) of the cylinder #4 in the next combustion, which has been reversed from the previously detected lean air-fuel ratio L(C) of the cylinder #1, and this means that reversal has occurred twice in succession. Therefore, in this case, since it is detected twice in succession that the air-fuel ratio of the cylinder #4 is rich, and in the meantime, it is detected that the air-fuel ratio of the cylinder #1 is lean, it can be determined that the air-fuel ratio of the cylinder #4 which indicates the rich air-fuel ratio R(B) is on the rich side.

Then, the combustion air-fuel ratio control section 42 decreases the quantity of fuel injected into the cylinder #4 by a predetermined quantity at a time point the rich air-fuel ratio R(D) of the cylinder #4 is detected, and the combustion air-fuel ratio leaning section 43 stores and learns the value (#4 leaned value (B)). On this occasion, the combustion air-fuel ratio control section 42 increases the quantity of fuel injected into the cylinder #1 by the same quantity.

Next, a lean air-fuel ratio L(E) of the cylinder #1 is detected, which has been reversed from the rich air-fuel ratio R(D) of the cylinder #4. That is, the determination results have been reversed twice in succession from the lean air-fuel ratio L(C) of the cylinder #1. Therefore, in this case, it is determined that the cylinder #1 which indicates the lean air-fuel ratio L(C) is on the lean side, and at a time point the lean air-fuel ratio L(E) of the cylinder #1 is detected, the quantity of fuel injected into the cylinder #1 is increased by a predetermined quantity (#1 leaned value (C)). On this occasion, the quantity of fuel injected into the cylinder #4 is decreased by the same quantity. Then, the leaned value is accumulated on the previously leaned value.

Thereafter, if reversal has occurred twice in succession, leaned values such as #4 leaned value (D), #1 leaned value (E), #4 learned value (F), and #1 leaned value (G) are leaned insofar as they do not exceed a predetermined limit value. It should be noted that reversal has not occurred twice in succession at a time point a lean air-fuel ratio L(J) of the cylinder #4 is detected and at a time point a lean air-fuel ratio L(K) of the cylinder #1 is detected, and hence the fuel injection quantity is not compensated. By compensating the fuel injection quantity in this way, the output voltage from the $O_2$ sensor 30 does not cross the mean value with respect to the cylinders #1 and #4. In other words, the output voltage from the $O_2$ sensor 30 does not rise or fall in synchronism with exhaust cycles, but gradually varies as time passes.

After a period of time since the output voltage from the $O_2$ sensor 30 stops repeatedly rising and falling, the output voltage from the $O_2$ sensor may start repeatedly rising and falling again.

In the illustrated example, a lean air-fuel ratio L(L) of the cylinder #1 is detected, and then a lean air-fuel ratio L(M) of the cylinder #4 is detected. Thus, reversal has not occurred. However, a rich air-fuel ratio R(N) of the cylinder #1 is detected next, which has been reversed from the lean air-fuel ratio L(M) of the cylinder #4. Next, a lean air-fuel ratio L(O) of the cylinder #4 is detected, and thus, reversal has occurred twice in succession. Therefore, in this case, it is determined that the air-fuel ratio of the cylinder #4 is on the lean side, and at a time point the lean air-fuel ratio L(O) of the cylinder #4 is detected, the quantity of fuel injected into the cylinder #4 is increased (#4 leaned value (M)). On this occasion, the quantity of fuel injected into the cylinder #4 is decreased by the same quantity. This leaned value is accumulated on the previously leaned value.

Next, a rich air-fuel ratio R(P) of the cylinder #1 is detected, which has been reversed from the lean air-fuel ratio L(O) of the cylinder #4. That is, the determination results have been reversed twice in succession from the rich air-fuel ratio R(N) of the cylinder #1. Therefore, in this case, it is determined that the cylinder #1 is on the rich side, and at a time point the rich air-fuel ratio R(P) of the cylinder #1 is detected, the quantity of fuel injected into the cylinder #1 is increased by a predetermined quantity (#1 leaned value (C)). On this occasion, the quantity of fuel injected into the cylinder #4 is increased by the same quantity. Then, the leaned value is accumulated on the previously leaned value.

Thereafter, if reversal has occurred twice in succession, leaned values such as #4 leaned value (O), #1 leaned value (P), #4 learned value (Q), and #1 leaned value (R) are obtained insofar they do not exceed a predetermined limit value. It should be noted that reversal has not occurred twice in succession at a time point a rich air-fuel ratio R(U) of the cylinder #4 is detected and at a time point a rich air-fuel ratio R(V) of the cylinder #1 is detected, and hence the fuel injection quantity is not compensated. By compensating the fuel injection quantity in this way, the output voltage from the $O_2$ sensor 30 does not cross the mean value with respect to the cylinders #1 and #4. In other words, the output voltage from the $O_2$ sensor 30 does not rise or fall in synchronism with exhaust cycles, but gradually varies as time passes.

As described above, in the present embodiment, the air-fuel ratio control apparatus for the multiple cylinder engine is constructed such that the plurality of catalytic converters 28 and 29 and the plurality of $O_2$ sensors 30 and 31 are disposed in parallel in the dual type exhaust manifold 20, and the fuel injection quantity is compensated for by comparative evaluation of the cylinders, and hence tuning for reducing variations in exhaust air-fuel ratio can be made easier. Also, whether the fuel injection quantity is compensated for or not is determined only based on an output voltage from the $O_2$ sensor when it crosses a median value thereof, and therefore, control stability can be improved as compared with the case where whether the fuel injection quantity is compensated for or not is continuously determined.

Furthermore, the use of the $O_2$ sensors makes it possible to provide the above-described control without increasing costs. Also, since variations in exhaust air-fuel ratio among the cylinders are leaned and compensated for when the engine is idling, and the leaned variations are properly reflected even when the engine is not idling, a high catalyst purification rate can be maintained. This reduces costs since catalytic noble metals can be decreased.

It should be understood that the present invention is not limited to the embodiment described above, but various changes in or to the above-described embodiment may be possible without departing from the spirits of the present invention.

For example, although in the above described embodiment, the $O_2$ sensors is used to, e.g., reduce costs as compared with the case where a linear type A/F sensor is used, a linear type A/F sensor may be used for the above described air-fuel ratio control, and even in this case, it is possible to obtain such an effect that turning for reducing variation in exhaust air-fuel ratio is made easier.

Further, although in the above described embodiment, the four cylinder engine based on the dual type exhaust manifold system is used, the present invention is not limited to this. The present invention may be applied to an engine based on a single type exhaust manifold system, and may also be applied to other types of multiple cylinder engines. For example, even if one catalyst handles the flow of exhaust gas from three cylinders as in the case of one bank in a V type six cylinder engine, compensation is carried out on the same principle as described above. Specifically, in one cylinder group, if combustion is performed in cylinders #1, #3, and #5 in this order, the exhaust air-fuel ratios of the cylinders #1, #3, and #5 are rich, lean, and rich, respectively, and it is determined that the exhaust air-fuel ratio of the cylinder #1 at a time point the exhaust air-fuel ratio of the cylinder #1 is on the rich side, and the quantity of fuel injected into the cylinder #1 is decreased by X (%). On this occasion, the quantity of fuel injected into the cylinders #3 and #5 is increased by X/2 (%). This reduces variations in exhaust air-fuel ratio among cylinders, and maintains the average air-fuel ratio of all the cylinders.

What is claimed is:

1. An air-fuel ratio control apparatus for a multiple cylinder engine, comprising:

an exhaust passage into which exhaust gas from a plurality of cylinders in the multiple cylinder engine flows;

a catalytic converter provided in said exhaust passage;

air-fuel ratio detecting means, provided upstream of said catalytic converter in said exhaust passage, for generating a detection output corresponding to an exhaust air-fuel ratio;

exhaust air-fuel ratio variation determining means for determining that there is a variation in exhaust air-fuel ratio between one cylinder and other cylinder when an output for one cylinder from said air-fuel ratio detecting means indicates one of a rich side and a lean side twice in succession, and in the meantime, an output for the other cylinder from said air-fuel ratio detecting means indicates other one of the rich side and the lean side from the air-fuel ratio indicated by the detection value for the one cylinder; and combustion air-fuel ratio control means for controlling the fuel injection quantity according to a detention output from said air-fuel ratio detecting means to adjust an average air-fuel ratio of exhaust gas flowing into said catalytic converter to about a stoichiometric air-fuel ratio, and for, when said exhaust air-fuel ratio variation determining means determines that there is a variation in the exhaust air-fuel ratio, compensating for the fuel injection quantity to reduce the variation.

2. An air-fuel ratio control apparatus for a multiple cylinder engine according to claim 1, wherein when said exhaust air-fuel ratio variation determining means determines that there is a variation in the exhaust air-fuel ratio, said combustion air-fuel ratio control means compensates for quantity of fuel injected into the one cylinder and quantity of fuel injected to the other cylinder in opposite directions to maintain an average exhaust air-fuel ratio of the one cylinder and the other cylinder.

3. An air-fuel ratio control apparatus for a multiple cylinder engine according to claim 1, wherein said exhaust air-fuel ratio variation determining means carries out the determination only when the engine is idling.

4. An air-fuel ratio control apparatus for a multiple cylinder engine according to claim 1, wherein said combustion air-fuel ratio control means inhibits compensation of the fuel injection quantity while a fuel system of the engine is purging.

5. An air-fuel ratio control apparatus for a multiple cylinder engine according to claim 1, further comprising:

combustion air-fuel ratio leaning means for storing and learning the compensated fuel injection quantity, wherein said combustion air-fuel ratio control means lowers a degree of dependency on fuel injection quantity learned by said combustion air-fuel ratio leaning means as quantity of fuel taken into the engine increases.

6. An air-fuel ratio control apparatus for a multiple cylinder engine according to claim 1, wherein said air-fuel ratio detecting means includes, an $O_2$ sensor that outputs an ON/OFF signal according to whether an exhaust air-fuel ratio is rich or lean, and said exhaust air-fuel ratio variation determining means determines that the exhaust air-fuel ratio is rich when the exhaust air-fuel ratio is greater than a median value of output voltage from said $O_2$ sensor, determines that the exhaust air-fuel ratio is lean when the exhaust air-fuel ratio is smaller than the median value, and detects that there is a variation in exhaust air-fuel ratio between the one cylinder and the other cylinder according to a result of the determination.

* * * * *